United States Patent [19]

Wilson et al.

[11] Patent Number: 4,480,556

[45] Date of Patent: Nov. 6, 1984

[54] ADJUSTABLE FOLDING IRONING BOARD

[75] Inventors: Kermit H. Wilson, Edina; Ronald R. Carlson, Excelsior, both of Minn.

[73] Assignee: Sico Incorporated, Minneapolis, Minn.

[21] Appl. No.: 339,406

[22] Filed: Jan. 15, 1982

[51] Int. Cl.[3] ..... D06F 81/00

[52] U.S. Cl. ..... 108/48; 38/103

[58] Field of Search ..... 108/134, 42, 48, 35; 38/103

[56] References Cited

U.S. PATENT DOCUMENTS

| | | | |
|---|---|---|---|
| 856,962 | 6/1907 | Kelly et al. | 108/48 X |
| 1,420,206 | 6/1922 | Milam | 108/48 |
| 1,583,280 | 5/1926 | Cummings | 108/42 |
| 1,909,093 | 5/1933 | Buffelen | 108/48 X |
| 2,014,549 | 9/1935 | Behm | 108/48 X |
| 2,517,256 | 8/1950 | Summers . | |
| 2,636,549 | 4/1953 | Geller | 108/48 X |
| 2,680,314 | 6/1954 | Snyder . | |
| 3,185,278 | 5/1965 | Miller et al. . | |
| 3,730,107 | 5/1973 | Bergkamp et al. . | |
| 3,742,868 | 7/1973 | Garceau et al. . | |
| 3,965,588 | 6/1976 | Long | 38/103 |

*Primary Examiner*—William E. Lyddane
*Assistant Examiner*—Peter A. Aschenbrenner
*Attorney, Agent, or Firm*—Merchant, Gould, Smith, Edell, Welter & Schmidt

[57] ABSTRACT

A folding ironing board including a mounting mechanism for mounting the ironing board to a wall or other support. The mounting mechanism includes pivotally connected support and control members for permitting folding movement of the ironing board between a generally horizontal use position and a generally vertical storage position adjacent the wall. Height control arms pivotally connect from the wall to the control arms and can be pivoted by releasing latch members to move the ironing board between two separate working heights, with the support members pivoting accordingly. A turntable or other pivot mounts the ironing board to the mounting mechanism to permit adjustment of angular orientation in the use position.

6 Claims, 4 Drawing Figures

ADJUSTABLE FOLDING IRONING BOARD

BACKGROUND OF THE INVENTION

This invention pertains to the field of folding ironing boards, and more particularly the present invention pertains to an improved ironing board that is quickly and securely adjustable in height and orientation, and which may be quickly and conveniently moved to and from a compact storage position against a wall or in a cabinet.

BACKGROUND OF THE PRIOR ART

Wall mounted folding ironing boards can provide great convenience and space efficiency in a home because they can be folded out when needed for ironing, and can be folded out of the way against a wall, or out of sight in a cabinet or closet when not needed. If well designed and made, a wall mounted folding ironing board can be much more efficient and convenient to use compared with a conventional ironing board. To use a conventional ironing board it must first be manually carried from a closet or other storage space, and manually supported while setting up the legs, etc. By contrast, a well designed wall mounted unit can pivot from the wall while being partially supported thereby, requiring less physical effort. An added benefit is that it cannot be misplaced since it always is stored in the same place.

Unfortunately, many prior art wall mounted folding ironing boards have suffered disadvantages in one or more of several areas. Some units have lacked rigidity in their use position, making them somewhat unstable especially if heavy pressure is applied during ironing. Others have had folding mechanisms that might partially fold or collapse if pressure were placed on the wrong part of the ironing board during use. Others have been rather large and lacked compactness in the storage position, resulting in either extending too far into the room, or requiring a cabinet or closet of considerable depth; in any case, using up valuable space. Still other prior art wall mounted folding ironing boards have been lacking or extremely limited in the amount of adjustment that can be provided, both in terms of height adjustment and rotation orientation within the room, with the result that the ironing board is often at an awkward position with respect to the height of a particular person using the ironing board, with respect to proximity to other objects or furniture in the room, or with respect to full utilization of the entire surface of the ironing board. Other designs have provided for some adjustability, but often the adjustment for height has required inconvenient separate adjustment steps for the back and leg portion in order to keep the surface level.

These and other problems associated with the prior art wall mounted folding ironing boards are overcome by the present invention.

SUMMARY OF THE INVENTION

The present invention provides an improved folding ironing board for mounting to a wall or other support which provides a stable rigid work surface in the use position, convenient one step adjustment of height while maintaining the work surface horizontal in either working position, convenient rotation to different orientations within the room, and simple folding to a compact storage position.

An ironing board surface member is provided, together with means for mounting the ironing board surface member to a wall or other support, including pivotally connected support and control members for folding movement of the ironing board between a generally horizontal use position and a generally vertical storage position adjacent a wall or other support. Height control means are connected to the mounting means to permit adjusting the height of the ironing board surface member between upper and lower generally horizontal use positions. In a preferred embodiment a pair of height control arms are pivotally connected to the wall or other support, and receive fold-up control arms of the ironing board mounting means, so that the working height of the ironing board can be adjusted by pivoting the height control arms, with the pivoting support members adjusting accordingly to the lower horizontal working height. A turntable or other pivot means is provided for angular adjustment of the ironing board in the used position, and appropriate latches are preferrably provided for the height control and the folding movement to maintain the ironing board securely in the selected used position.

DETAILED DESCRIPTION OF THE PREFERRED EMBODIMENT

Figure 1:
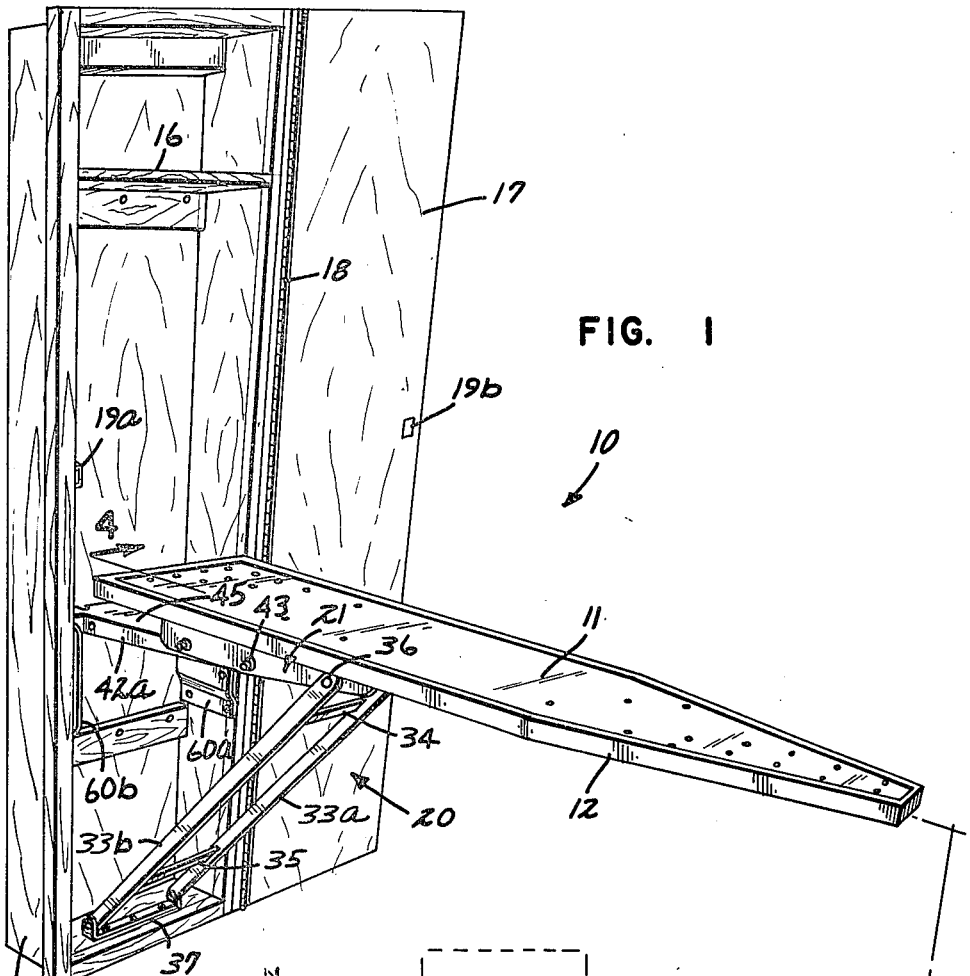
FIG. 1 is a view in perspective of an ironing board mounted in a storage cabinet according to the present invention, the ironing board in its use position.

Referring to the drawing, in which the same elements have the same numbers throughout the several figures, reference number 10 generally refers to a folding ironing board according to the present invention for mounting in a cabinet or to a wall or other support. Ironing board 10 consists generally of a surface member 11, and a folding and support mechanism 20. Surface member 11 consists of a planar surface member of conventional shape, which may be bounded by channel members 12 for added strength and rigidity. In FIG. 1, the ironing board is shown mounted in a cabinet 13, consisting of a rectangular frame 14 having a rectangular facing 15 therearound. The folding and support mechanism is secured to the frame as explained more fully below, for storage of the ironing board in a folded position within the confines of the cabinet. A shelf 16 may be provided in the upper portion of the cabinet, above the space needed for receiving the ironing board in its stored position, to provide a storage compartment to hold an iron or other accessories. Suitable electrical outlets can also be provided in the storage compartment for convenience. The cabinet frame would be installed in an appropriately sized opening or recess in a wall, and facing 15 would cover the edges thereof to give a finished appearance. A door 17 is secured to the cabinet by a suitable hinge 18, and can be held closed by a suitable latch 19*a*, 19*b*, when the ironing board is in the stored position.

Figure 2:
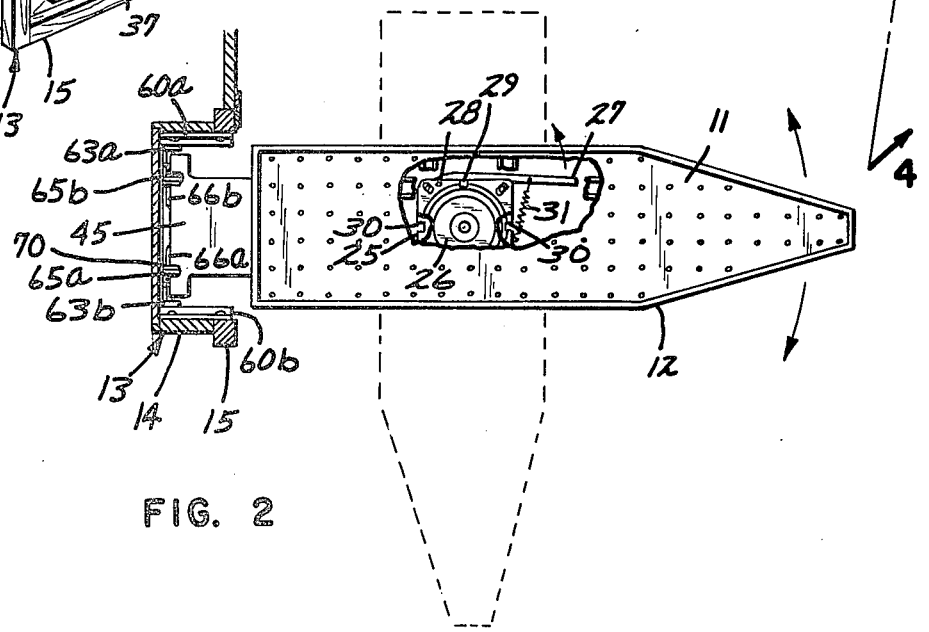
FIG. 2 is a horizontal section showing the ironing board of FIG. 1 in top plan, portions thereof broken away.
Figure 3:
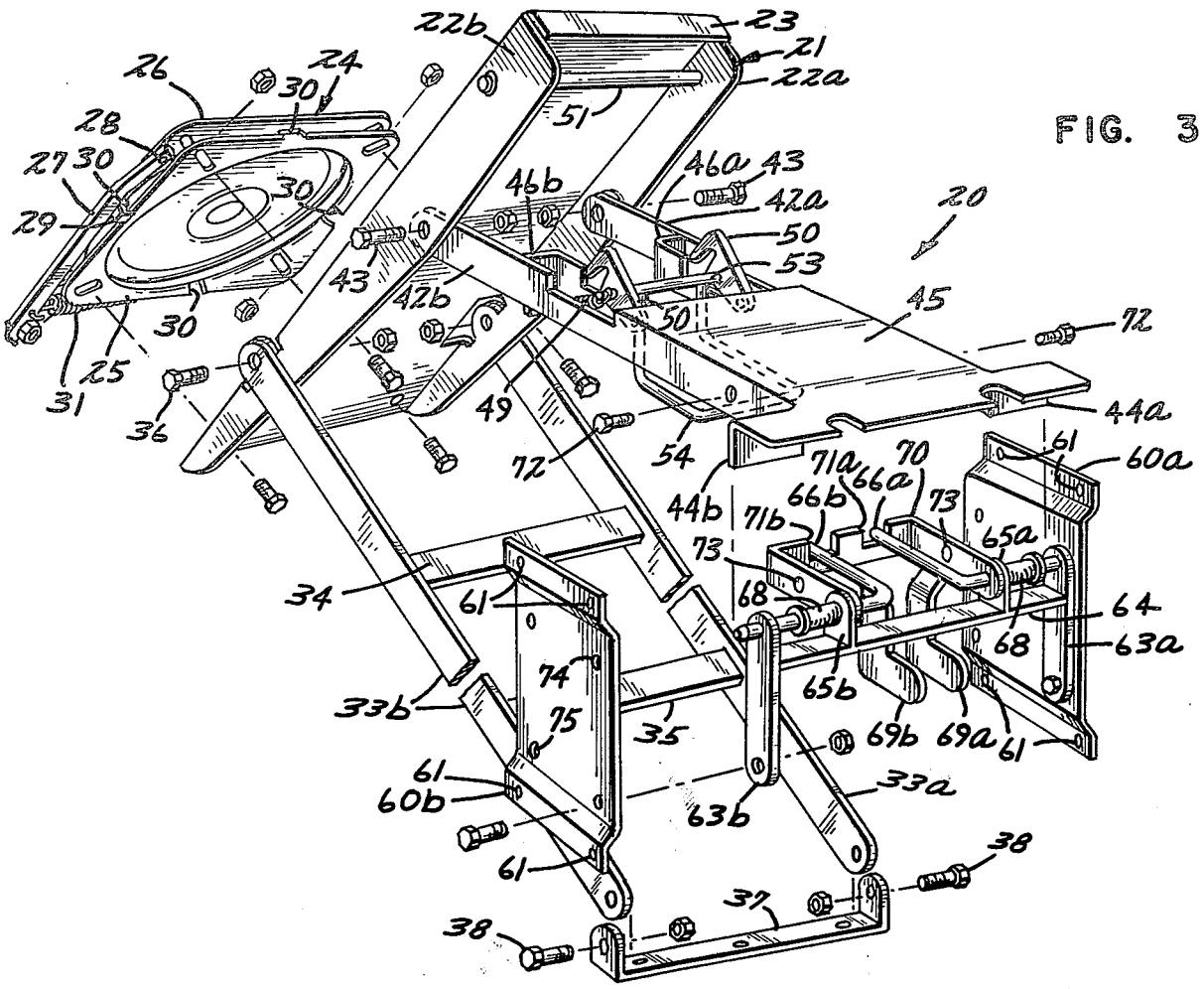
FIG. 3 is a partially exploded view in perspective of the folding-supporting mechanism for the ironing board of FIG. 1.

Referring now primarily to FIG. 3, the folding and support mechanism 20 is seen in greater detail. It includes a generally flat mounting platform or frame 21, having sidewall portions 22*a*, 22*b* and end portion 23. A turntable 24 is mounted to platform 21 and serves to mount the ironing board surface member 11 to the support and folding mechanism, while permitting angular movement thereof as shown in broken line in FIG. 2. Turntable 24 includes a base frame 25 which is secured to mounting platform 21 by a plurality of bolts, and a turning portion 26 to which ironing board surface member 11 is attached by suitable means, for example, bolts. Base portion 25 and turning portion 26 are rotatably secured together by conventional means not shown. A latch arm 27 is provided, pivotably mounted at 28 to the rotating portion 26. Latch arm 27 (which is partially broken away in FIG. 3) includes a latch dog 29 sized to fit into one of a plurality of latch slots 30 provided at various positions around the turntable. A bias spring 31 connects to latch arm 27 to normally hold latch dog 29 into one of slots 30 to prevent rotation, thus locking the ironing board in position. When the user wishes to change orientation, latch arm 27 is pulled outwardly, the ironing board surface member 11 is rotated to the new position, and latch arm 27 is released, locking the ironing board in the new position.

Folding and support mechanism 20 also includes a pair of support legs 33*a*, 33*b*, which are connected together by welded braces 34 and 35. Support legs 33*a* and 33*b* are pivotably connected to pivot holes provided in side walls 22*a* and 22*b*, respectively, of mounting platform 21, by means of suitable pivot bolts 36. The support legs extend downwardly from platform 21 to a mounting bracket 37, to which they are pivotably attached by pivot bolts 38. Mounting bracket 37 is adapted for securing by bolts or screws to the bottom portion of frame 14 of cabinet 13.

Folding and support mechanism 20 also includes a pair of control arms 42*a*, 42*b* having first ends pivotably connected by pivot bolts 43 to side wall portions 22*a*, 22*b*, respectively, of mounting platform 21, and having at their other ends, outwardly bent tab portions 44*a*, 44*b*. A generally planar interconnecting plate 45 is welded to the top edges of portions of control arms 42*a*, 42*b* including tab portions 44*a*, 44*b*.

Control arms 42*a* and 42*b* are securely attached by bolts 72 which pass through holes therein and through holes 73 in "U" shaped bracket 70.

Control arms 42*a* and 42*b* each have a small housng portion 46*a*, 46*b* (see FIGS. 3 and 4) formed of generally "L" shaped pieces which are welded to the control arms and to a flange portion 47 of interconnect plate 45. A pair of latches 50 are pivotably mounted by pivot pins 48 to housings 46*a*, 46*b*, respectively, and have slots for engaging latch bar 51 which is mounted on the underside of mounting platform 21, between side walls 22*a* and 22*b* thereof. A rod 53 is connected between latches 50, and a control lever 54 in the form of a loop is welded to rod 53 for actuation of the latches. A pair of springs 49 are provided for normally urging the latch to the closed position.

A pair of support plates 60*a*, 60*b* are provided for mounting the folding and supporting mechanism into the cabinet. Specifically, support plates 60*a*, 60*b*, have a plurality of mounting holes 61 along their top and bottom edges enabling them to be screwed into frame 14 of the cabinet. Support plates 60*a*, 60*b*, also have holes through which pivot pins pass to pivotably mount a pair of height control arms 63*a*, 63*b*. Support plates 60*a*, 60*b* are bent to provide clearance for the heads of the pivot bolts. A cross brace bar 64 connects between height control arms 63*a* and 63*b* and is welded thereto. Cross brace 64 has a pair of pads 65*a*, 65*b* welded thereto. Pads 65*a* and 65*b* have apertures therein, which receive "L" shaped locking pins 66*a* and 66*b*, respectively. A "U" shaped bracket 70 has apertured ends adjacent tabs 65*a* and 65*b* and "L" shaped locking pins 66*a* and 66*b* pass through these also. One end of locking pin 66*b* passes through a clearance hole in the end of height control arm 63*b* for engagement in either hole 74 or 75 of support plate 60*b*. In the position shown, the locking pin is aligned to engage hole 74, with hole 75 being used for the alternate height adjustment position as explained later. The other end of locking pin 66*b* is contained in a clearance and locating slot 71*b* in bracket 70. On the other side of the apparatus, locking pin 66*a* is similarly configured and positioned with one end in clearance and locating slot 71*a* and the other end extending through height control arms 63*a* to engage a hole in support plate 60*a*. Compression springs 68 are provided together with suitable stop washers on locking pins 66*a* and 66*b* to normally urge the locking pins outwardly to engage the holes in support plates 60*a* and 60*b*.

A pair of actuating tabs 69*a* and 69*b* are welded to locking pins 66*a* and 66*b*, and extend below cross brace 64, where they may be reached by the operator and squeezed together to withdraw locking pins 66*a* and 66*b* from the holes 74 or 75 in support plates 60*a* and 60*b* to permit adjustment of height.

Figure 4:
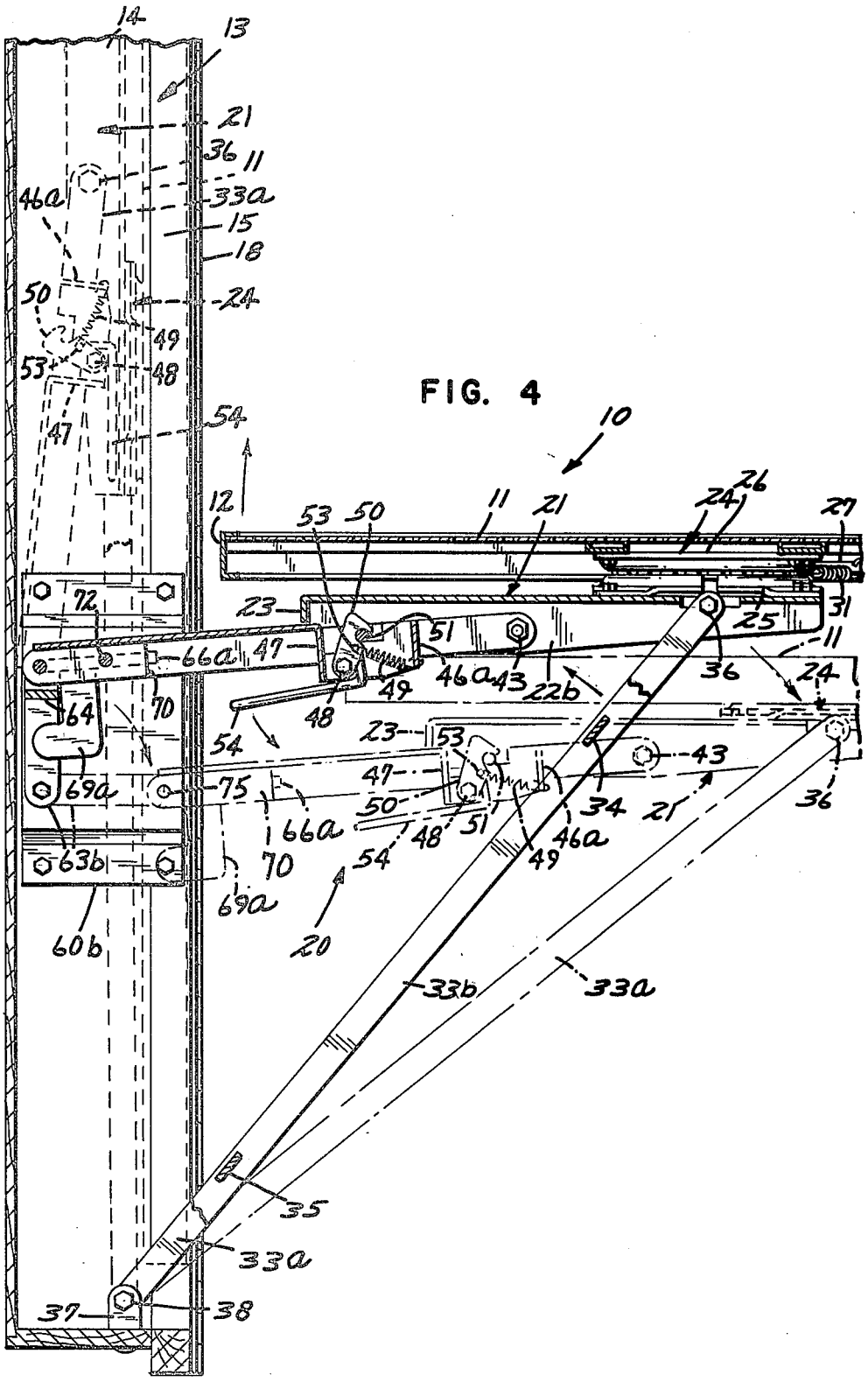
FIG. 4 is a view in vertical section and seen along line 4—4 of FIG. 1, at an enlarged scale.

The operation of the ironing board folding and support mechanism is illustrated in FIG. 4, in which the ironing board and support mechanism is shown in solid line for a higher use position, and in broken line for a lower use position and also for the stored position within the cabinet. In either use position, the ironing board is securely supported by support legs 33*a*, 33*b* and control arms 42*a*, 42*b*, whose ends are connected via bracket 70 to cross brace 64. Cross brace 64 is held securely in position by height control arm 63*a* and 63*b*, which are pivoted to support plates 60*a*, 60*b* at one end, and are secured thereto by locking pins 66*a*, 66*b* at their other ends. Latches 50 engage latch bar 51 to further hold the ironing board securely in position. In the upper position, height control arms 63*a*, 63*b* are in a vertical position with the locking pins engaging the upper holes 74. The support plates in turn are securely fastened to the frame 14 of the cabinet, as is bracket 37 for the support legs.

To switch the ironing board to the lower position, all that is required is to reach under the ironing board and squeeze actuating tabs 69*a*, 69*b*, together to unlock locking pins 66*a*, 66*b*. The height control arms then can pivot outwardly and downwardly to the horizontal position, at which point the compression springs 68 engage locking pins 66*a*, 66*b*, with holes 75 in the support plates to again secure the ironing board. In movement from the upper to lower position, the height control arms bring the control arms and mounting plate downwardly and slightly outwardly. At the same time, support legs 33*a*, 33*b*, pivot outwardly. The relative length and mounting positions for the support legs, control arm, height control arms, supporting plates, and mounting platform are chosen so that the ironing board surface member 11 will remain horizontal in both the upper and lower positions.

To return the ironing board to the upper position, tabs 69*a*, 69*b* are again pushed together to release the pins and the ironing board is moved to the upper position.

While in either the upper or lower position, the ironing board surface member can be rotated angularly as desired and locked in place at 3 perpendicular positions by reaching under the ironing board to release latch arm 27 for the turntable and rotating the ironing board. This permits full utilization of the ironing board surface, front and back, as well as permitting turning the ironing board for minimum interference with other activities in the room.

To fold the ironing board to the wall, it is first brought to the upper use position if it was previously at the lower use position. From the upper use position, control lever 51 is moved downwardly, releasing latches 50. The end of ironing board surface member 11 nearest the wall can then be swung upwardly while the other end is swung downwardly. Control arms 42*a*, 42*b* and support legs 33*a*, 33*b* move toward the wall, bringing the ironing board surface member in position within the cabinet recess, bottom side toward the back of the cabinet and top or working side facing outwardly to the room. Once folded up, the ironing board will remain in the cabinet due to its own weight in relation to the position of the lower pivot point 38 for the support legs. The door can then be closed.

To unfold the ironing board, the entire ironing board is pulled outwardly from the cabinet, and it will swing outwardly and downwardly under control of control arm 42*a*, 42*b* and support legs 33*a*, 33*b*. The back end of the ironing board surface member 11 is then pushed downwardly, or alternatively, the outer tip is pulled upwardly, to engage latches 50 with latch bar 51. In the use position, the ironing board is secure and will not collapse or tip if weight is applied over any portion of the surface.

We have thus provided a fully adjustable, stable and compact folding wall mounted ironing board, which permits secure and simple one step adjustment or height in orientation, and yet stores in a compact position against the wall or within an enclosure.

What is claimed is:

1. An adjustable folding ironing board for attachment to a wall or other support, comprising:

a mounting frame;

an ironing board surface member;

turntable means for rotatably securing said ironing board surface member to said mounting frame;

support leg means pivotally connected at one end thereof to said mounting frame, including means for pivotal connection of the other end thereof to said wall or other support;

height control means for securing to said wall or other support at a position above the connection of said support leg means;

fold-up control arm means pivotally connected at one end thereof to said mounting frame and including means pivotally connecting the other end thereof to said height control means, said support leg means and fold-up control arm means configured to permit folding of said ironing board between a generally horizontal use position and a generally vertical storage position with the underside of the ironing board surface member adjacent the wall or other support; and said height control means including adjustable means for moving said fold-up control arm means between an upper position and a lower position with said support leg means pivoting accordingly to move said ironing board surface member to a further generally horizontal use position lower than the first use position.

2. An adjustable folding ironing board according to claim 1 further including latching means connected to said fold-up control arm means and said mounting frame for securing said ironing board in either of said use positions, and when actuated permitting folding to the storage position.

3. An adjustable folding ironing board according to claim 1 further including latching means for said height control means for securing said adjustable means in either of the said upper or lower positions.

4. An adjustable folding ironing board according to claim 1 wherein said height control means includes a pair of height control arms, means connecting first ends thereof to said fold-up control arm means, and means for pivotally connecting the other ends thereof to the wall or other support so that said height control arms can pivot to move the fold-up control arm means between upper and lower positions.

5. An adjustable folding ironing board according to claim 4 further including locking pins engaging said height control arms for locking them in said upper or lower position, and tab means for actuation by a user for releasing the locking pins to permit height adjustment.

6. An adjustable folding ironing board according to claim 2 wherein said latching means includes a latch bar on said mounting frame, a hook element pivotally connected to said fold-up control arm means for engagement of said latch bar with the ironing board in a use position, and an actuation member attached to said hook element for release of said latch.

* * * * *